US008769787B2

(12) United States Patent
Koehne

(10) Patent No.: US 8,769,787 B2
(45) Date of Patent: Jul. 8, 2014

(54) HEAD REMOVAL DEVICE FOR AN INTERNAL COMBUSTION ENGINE

(76) Inventor: Lonnie Koehne, Goliad, TX (US)

( * ) Notice: Subject to any disclaimer, the term of this patent is extended or adjusted under 35 U.S.C. 154(b) by 140 days.

(21) Appl. No.: 12/847,199

(22) Filed: Jul. 30, 2010

(65) Prior Publication Data

US 2011/0271506 A1 Nov. 10, 2011

Related U.S. Application Data

(60) Provisional application No. 61/332,494, filed on May 7, 2010.

(51) Int. Cl.
*B66C 1/10* (2006.01)

(52) U.S. Cl.
CPC .. *B66C 1/10* (2013.01); *B66C 1/107* (2013.01)
USPC ..... 29/239; 29/888.011; 29/244; 254/133 R

(58) Field of Classification Search
CPC ..... B66C 1/107; B66C 1/10
USPC ..... 29/239, 244, 252, 426.1, 426.3, 426.5, 29/426.6, 888.011; 212/223, 271; 294/82.1, 82.17, 215; 254/20, 85, 424, 254/103, 97, 98, 133 R, 134, 100, 4 R, 9 B, 254/7 B, 108
See application file for complete search history.

(56) References Cited

U.S. PATENT DOCUMENTS

| | | | | | |
|---|---|---|---|---|---|
| 115,844 | A | * | 6/1871 | Hall | 414/638 |
| 1,529,518 | A | | 3/1925 | Voeller | |
| 2,159,593 | A | | 5/1939 | Klermund | |
| 2,229,256 | A | * | 1/1941 | Pfauser et al. | 29/239 |
| 2,237,913 | A | | 4/1941 | Foland | |
| 2,456,917 | A | | 12/1948 | Cheek | |
| 2,846,188 | A | | 8/1958 | Pierce | |
| 2,905,337 | A | * | 9/1959 | Cutshall | 212/201 |
| 5,971,178 | A | * | 10/1999 | Ratcliff et al. | 212/271 |
| 2003/0131460 | A1 | | 7/2003 | Burns | |

* cited by examiner

*Primary Examiner* — David Bryant
*Assistant Examiner* — Steven A Maynard
(74) *Attorney, Agent, or Firm* — Jackson Walker, LLP

(57) ABSTRACT

A head lifting device for lifting the head off of an internal combustion engine. The head lifting device is typically used for an engine having multiple separate heads. It includes a crane assembly that has a support member. At one end of the support member is a bracket for attaching to a first head. At the second end of the support member is a gearbox. The second end of the support member is positionable over a second head, the second head typically being adjacent the first head. Hanging down from the gearbox is a shaft threaded, and at the end of the shaft is an assembly for engaging the second head. Driving the gearbox will allow the shaft to move upward through the gearbox and, with a second head attached thereto, allow the second head to lift off the engine block.

9 Claims, 6 Drawing Sheets

HEAD REMOVAL DEVICE FOR AN INTERNAL COMBUSTION ENGINE

This application claims priority from, the benefit of, and incorporates by reference, U.S. Provisional Patent Application Ser. No. 61/332,494, filed May 7, 2010.

FIELD OF THE INVENTION

Head lifting devices, more specifically, a device for lifting the head off of an internal combustion engine.

BACKGROUND OF THE INVENTION

Internal combustion engines typically have an engine block, typically including cylinders for reciprocating pistons and structure to mount a crankshaft and other elements. Heads are typically placed on the block with a multiplicity of fasteners or studs. A gasket is usually placed between the head and the block, this gasket called a head gasket.

Heads can either be separate or unitary. For example, a unitary head would be a single head which engages a multiplicity of cylinders. For example, in the V-6 or V-8 engine typically found on modern American road cars, there are two heads, one for each bank of cylinders. On a straight 6 engine, however, where the cylinders are aligned along a single longitudinal axis, there may be only one unitary head. However, some large tractors or industrial engines have separate heads for each cylinder.

Repair or maintenance to the internal combustion engine sometimes require removal of the head.

Industrial engines or earth moving equipment engines, for example, the Caterpillar 3500 engine are quite heavy and have separate heads. The Caterpillar 3500 engine is an industrial multi-purpose engine that may be used as a generator or used on drilling rigs or the like. It comes in 8, 12, 16 or 20 cylinder models, all having V blocks and overhead valves.

As may be imagined, the removal of the heads, even though separate heads, on such a large engine, for example, the Caterpillar 3500 Series engine, is difficult. This difficulty is due in part to the weight, location, and design configuration of the blocks.

OBJECTS OF THE INVENTION

It is an object of the invention to provide a sturdy, easy-to-use mechanical assembly to assist in removing cylinder heads from cylinder blocks.

SUMMARY OF THE INVENTION

A mechanical device adapted to mount to a head adjacent to the head whose removal is desired, with a swivelable neck having a gearbox and lifting member attached thereto. At the end of the lifting member is located a head engaging assembly designed to retain fasteners that are threaded with preexisting block elements.

A head removing device for removing a head from an engine having multiple heads, the head removing device comprising at least a crane assembly. The crane assembly typically includes a support member having a first end and a second end, the crane assembly typically includes mounting means near the first end of the support member, the mounting means adapted to engage a first head of the engine. At least a portion of the support member is adapted to rotate about a vertical axis such that the second end of the support member is positionable over a second head of the engine. A gear box is typically located near the second end of the support member. The gearbox typically includes at least two gears meshingly engaged. A first of the at least two gears has a drive shaft. The drive shaft has a tool engaging portion thereon. The gearbox includes a gearbox housing for substantially enclosing the at least two gears and a lifting shaft having a longitudinal axis. The lifting shaft has a removed end. The lifting shaft engages a second of the at least two gears such that when such gear is rotated, the lifting shaft moves vertically. A head anchor assembly is attached to the removed end of the lifting shaft, the head anchor assembly including at least a pair of members adapted to receive at least a pair of anchor head engaging bolts. The gearbox housing includes walls, including a top wail and a bottom wall, and the first gear is engaged with the top and bottom wall, and rotatably articulates with respect to the top and bottom walls. The lifting shaft passes through the top wall and the bottom wall. The at least two gears include toothed outer perimeters for meshing engagement and the second of the at least two gears includes means to engage the lifting shaft such that rotation of the second gear imparts linear motion to the lifting shaft, along its longitudinal axis. The lifting shaft is threaded and means to engage the lifting shaft includes a threaded inner perimeter of the second gear. The removed end of the lifting shaft includes a hook, the hook adapted to engage the head anchor assembly. The members of the head anchor assembly are engaged with and separated by a horizontal cross-member. The hook of the lifting shaft is adapted to engage the horizontal cross-member.

A method for removing a head from an engine having multiple heads is disclosed. The method comprises the steps of providing a head removing device for removing a head from an engine having multiple heads. The head removing device is substantially as set forth in the paragraph above. The method includes the steps of: attaching the crane assembly of the head removing device to a first head of the engine; positioning the second end of the support member over a second head of the engine; first engaging the head anchor assembly to the second head; second engaging the lifting shaft to the head anchor assembly; third engaging the drive tool to the tool engaging portion of the drive shaft; rotating the drive shaft with the drive tool until the head is separated from the engine block; wherein the mounting means of the crane assembly of the head removing device includes an upper and a lower bracket and wherein the attaching step includes attaching the upper and lower brackets to the first head; removing the valve cover of the first head; attaching the upper bracket to the first head using bolts that hold a rocker box to the first head; attaching the lower bracket to threaded bolt holes in the first head; removing a valve cover, a rocker arm assembly, and a rocker box of the second head; the aforesaid steps being performed before the first engaging step; and providing a head handle, attaching the head handle to the second head.

BRIEF DESCRIPTION OF THE DRAWINGS

FIGS. 2A is a side elevational view of Applicant's head puller assembly (with the bracket assembly removed therefrom) illustrated attached to an adjacent head, that is, the head and block adjacent the head intended to be removed.

FIG. 2B is a side elevational view of a hook, also showing the lower end of a lifting shaft.

DETAILED DESCRIPTION OF THE PREFERRED EMBODIMENTS

Figure 1:
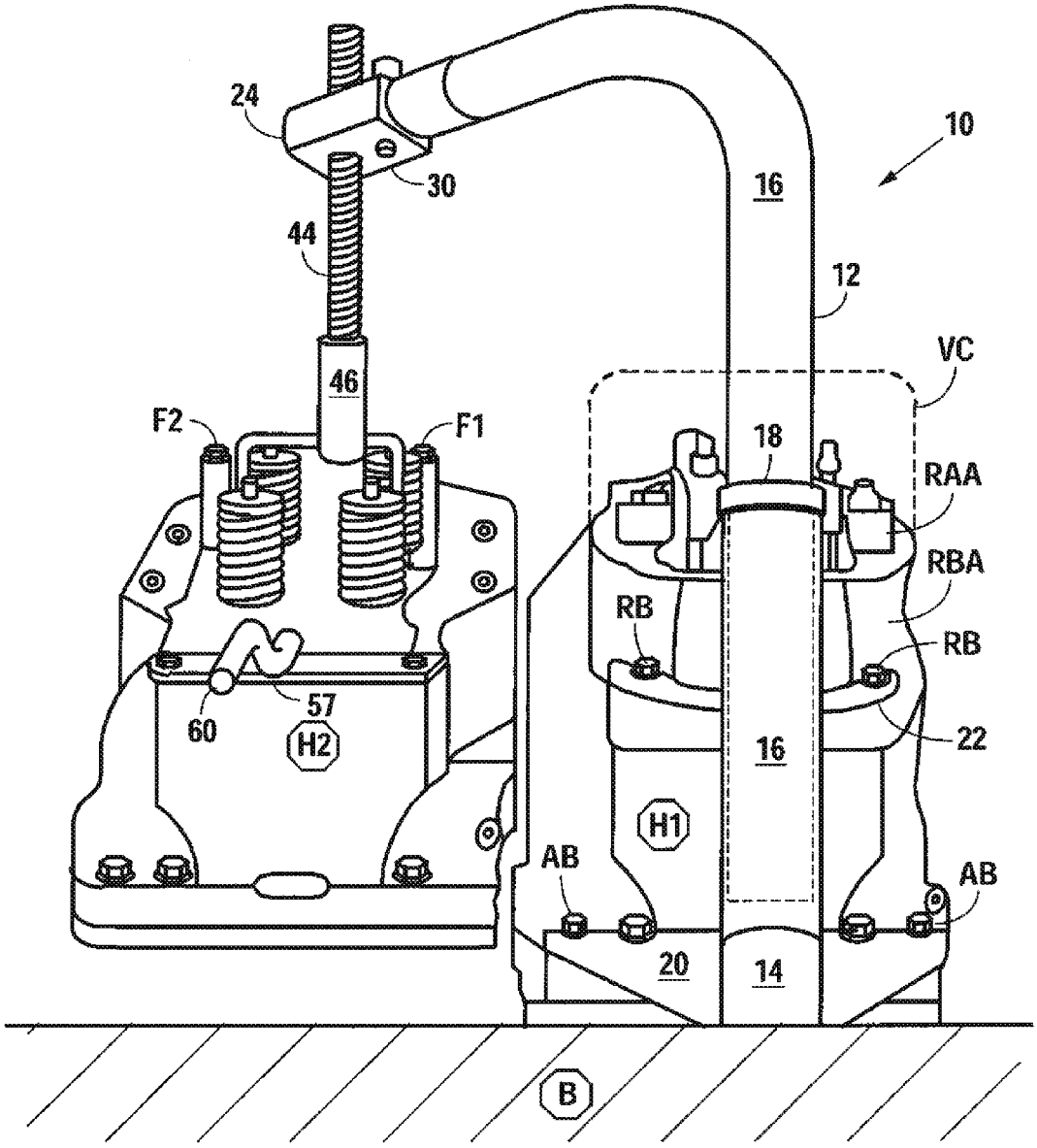
FIG. 1 is a perspective lower side view of Applicant's novel head puller assembly illustrated in use, that is, fitted to a head of a Caterpillar 3500 Series industrial engine, for engaging in the manner illustrated and as set forth herein, an adjacent head of the same engine to assist in the removal thereof.
Figure 1A:
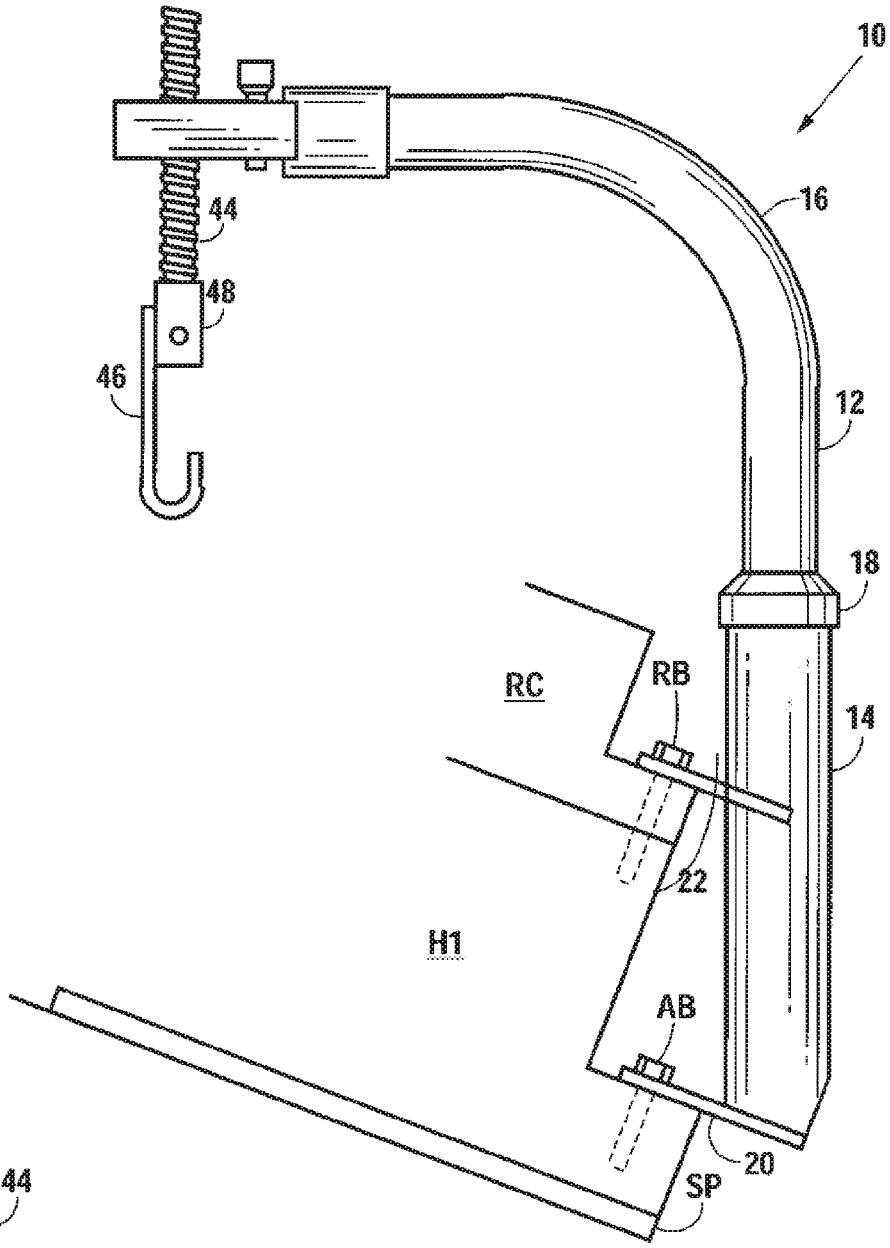
Figure 1B:
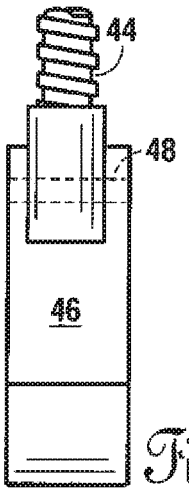
Figure 3:
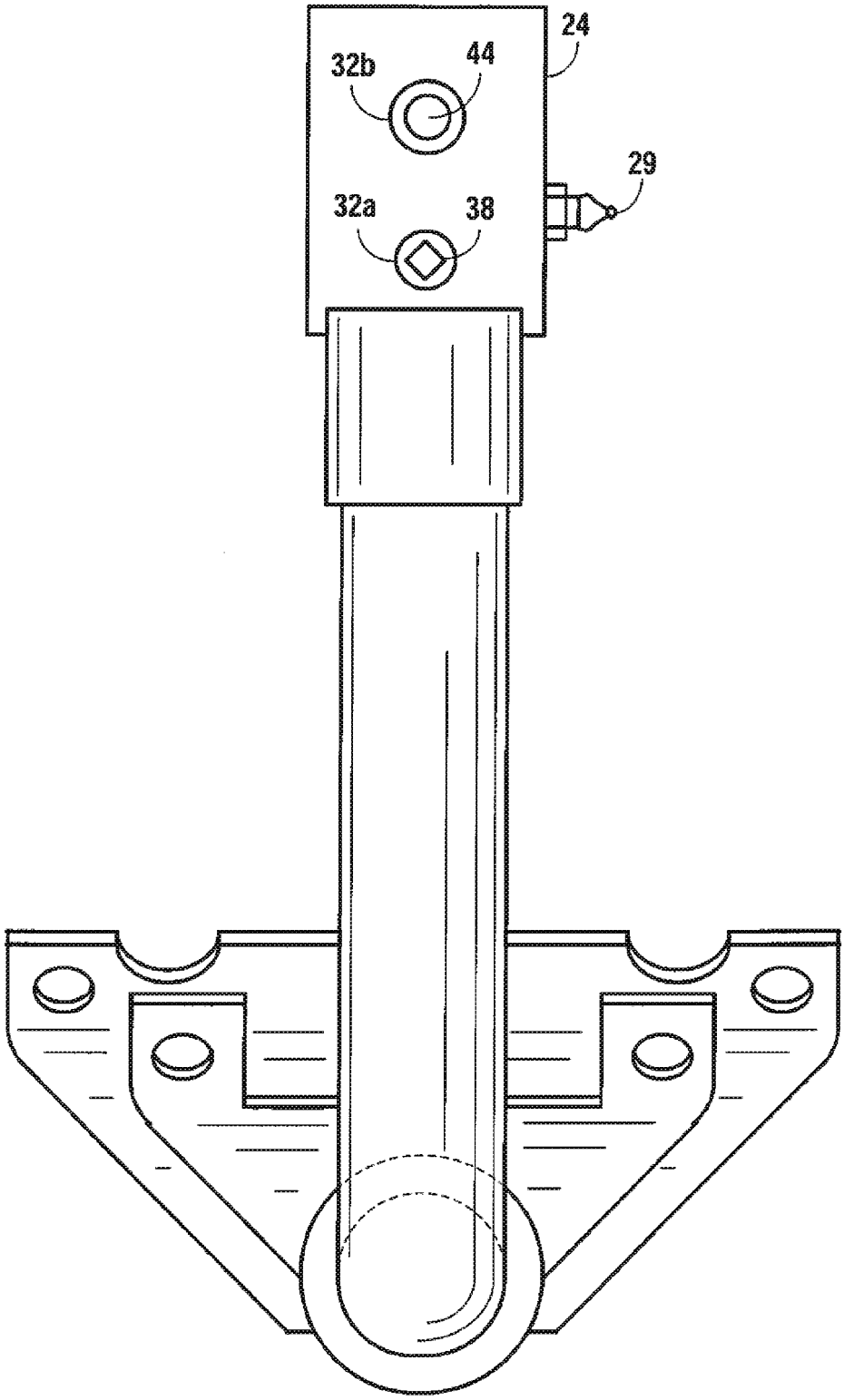
FIG. 3 is a top elevational view of the assembly as set forth in FIG. 2A, with the head and block removed therefrom.

FIG. 1 illustrates a block B and head of an industrial engine or other engine, such as a Caterpillar 3500 Series V-block engine having separate heads and, in this case, illustrating a head carrying an overhead valve assembly thereupon. FIG. 1 illustrates two adjacent heads, H1 being designated the "anchor head" and H2 the "removed head" (meaning the head intended to be removed by the use of Applicant's device). It is seen that the anchor head H1 is typically adjacent to the removed head H2 and provides a site for physically locating Applicant's novel head puller assembly 10 thereto, through the use of fasteners AB (accessory bolt holes) and RB (rocker box bolts) and bolt holes of head H1. Fasteners AB and RB may be preexisting fasteners, such as bolts, that thread into the heads. Fasteners AB and RB on anchor head H1 are used to anchor head assembly 10 and fasteners F1 and F2 on removed head H2 may be used to engage the head puller assembly 10 to removed head H2 to facilitate its removal. The valve cover VC is ghosted in on FIG. 1, and FIG. 1 shows the rocker arm assembly RAA and rocker box assembly RBA on head HI, and removed from head H2.

Head puller assembly 10 will typically utilize existing bolt receiving holes or existing studs of heads for both anchoring the head puller assembly 10 and for providing support for bolts or fasteners used for removing H2.

Turning now to the details of head puller assembly 10, it is seen to include a crane assembly 12. The crane assembly 12 includes a typically elongated, vertically trending fixed base 14 to which an at least partially rotatable neck 16 is engaged. Neck 16 is seen to have a vertical and transverse (horizontal) portion, the vertical portion for rotataby engaging base 14 by the use of collar 18. The collar 18 is slightly larger than the outer diameter of base 14, and is welded to the neck. Thus, it allows neck 16 to rotate on the base (base 14 is partially cut away to show how neck 14 slides into the base). The neck 16 is prevented from bottoming out in base 14 by the collar 18 riding on the upper perimeter of the cylindrical base 14. Collar 16 inserts into base 14 resting on collar 18 as shown in FIG. 1. The crane assembly may be made from tubular mild steel or other suitable material.

Base 14 is seen to have a first bracket 20 and a second bracket 22 engaged therewith, the brackets 20/22 including fastener receiving holes 20*a*/20*b*/22*a*/22*b* therein. Both brackets 20/22 are seen to engage crane assembly 12, typically through engagement with base 14 in a longitudinally spaced apart and angled manner as best seen in FIG. 2A, so as to provide a generally vertical alignment of base 14. The fasteners AB/RB that engage holes 20*a*/20*b*/22*a*/22*b* may be fasteners removed from the block or head H1 and reattached thereto after insertion through the holes of the bracket so as to maintain rigidly the base 14 anchored to anchor head H1.

Figure 4A:
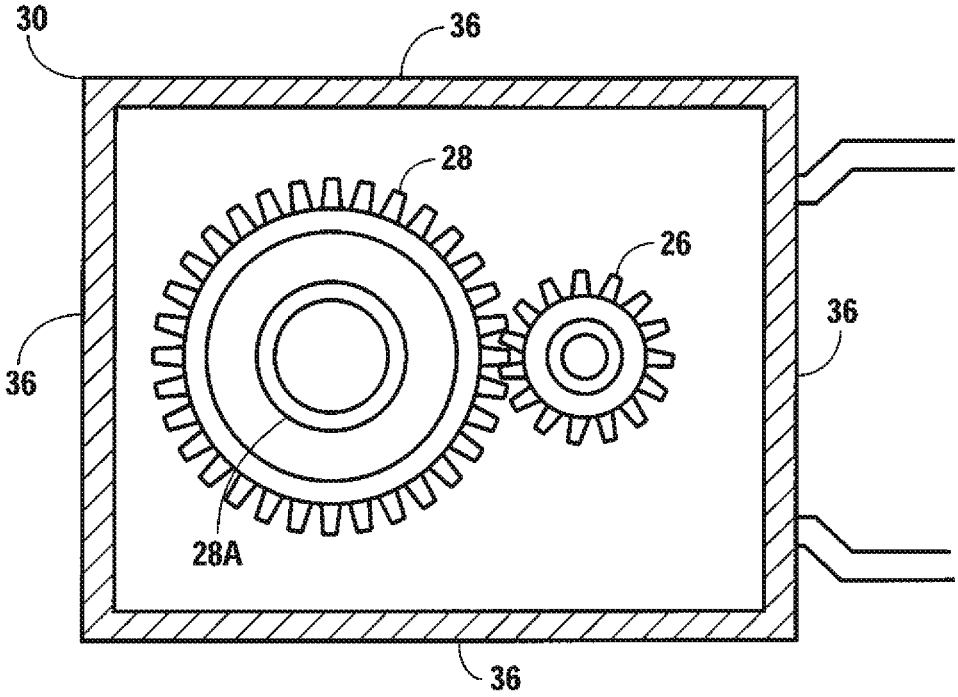
FIG. 4A is a cross-section top elevational view of a gearbox used in Applicant's device.
Figure 4B:
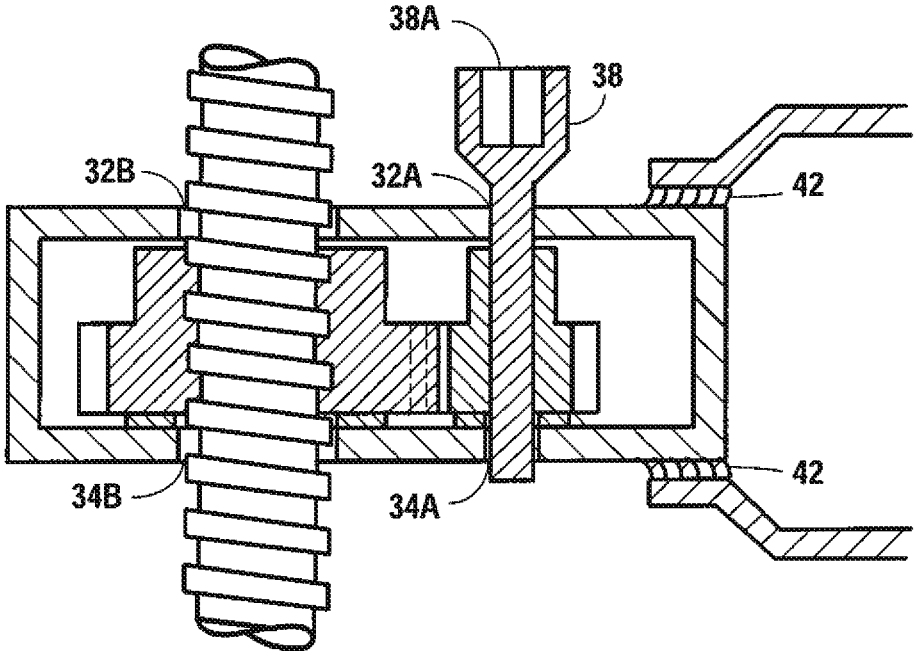
FIG. 4B is a cross-section side elevational view of the gearbox with the cross-section extending through the lifting shaft and driveshaft as well as the gears contained therein.
Figure 5A:
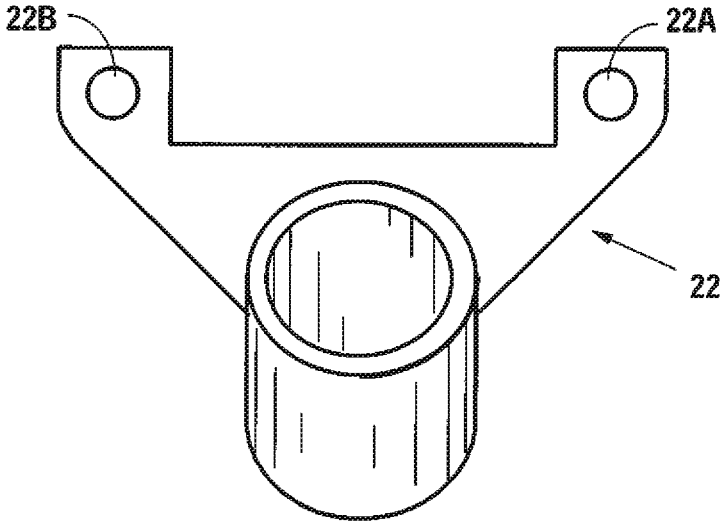
FIG. 5A is a top elevational view of a second bracket with a part of the base engaged therewith.
Figure 5B:
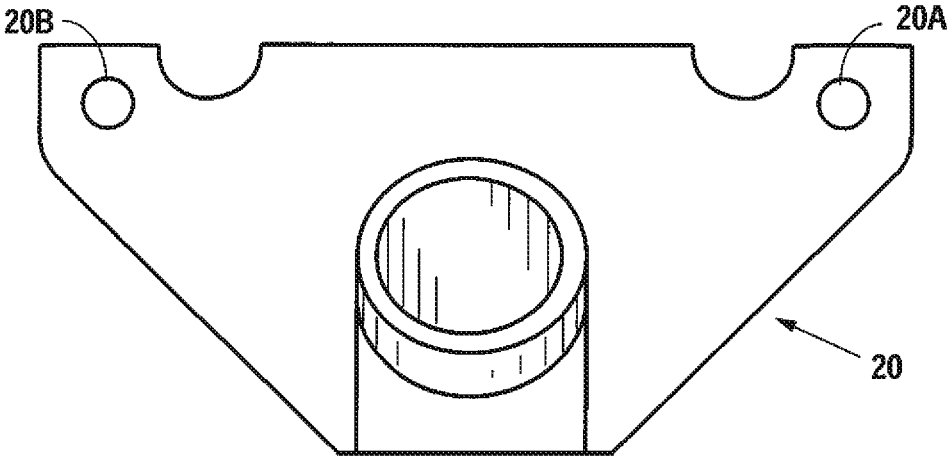
FIG. 5B is a top elevational view of a first bracket with a part of the base engaged therewith.
Figure 6B:
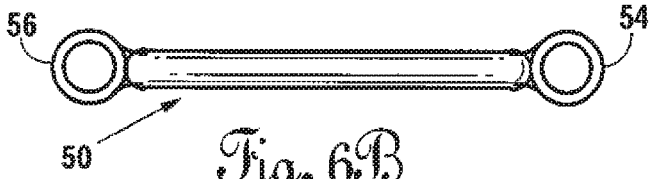
FIG. 6B is a top elevational view of the head anchor assembly of Applicant's device which head anchor assembly is designed to engage the hook as illustrated in FIG. 1.
Figure 6A:
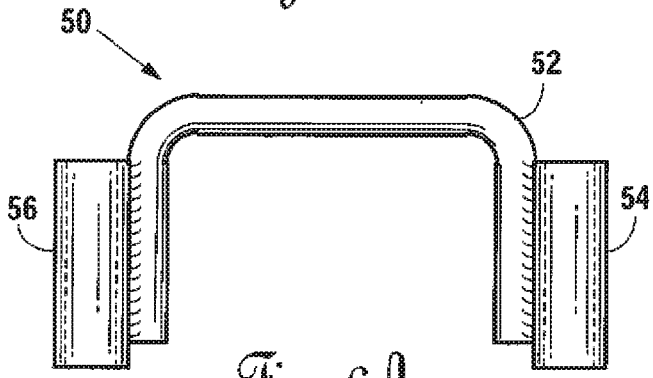
FIG. 6A is a side elevational view of the head anchor assembly of Applicant's device, which head anchor assembly is designed to engage the hook as illustrated in FIG. 1.
Figure 7A:
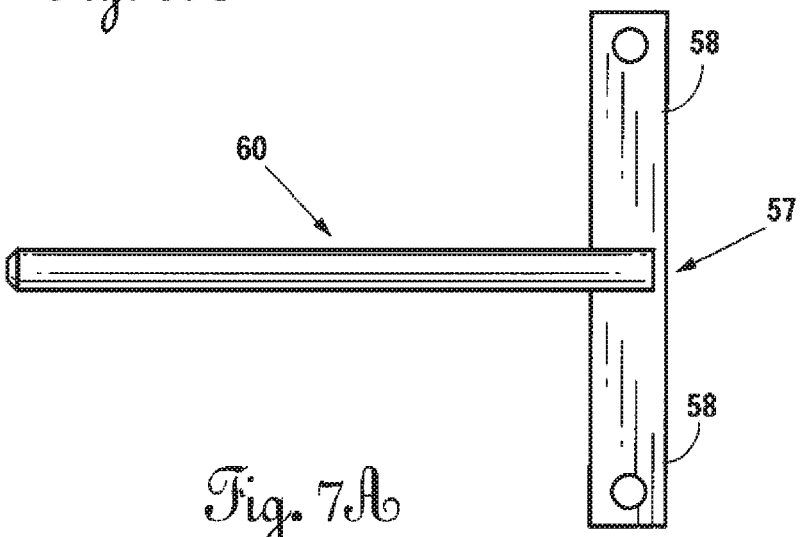
FIG. 7A is a top elevational view of a head handler, which may be used in conjunction with Applicant's head puller assembly.
Figure 7B:
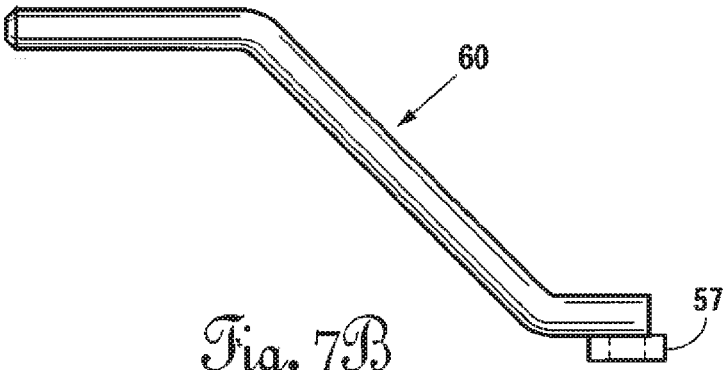
FIG. 7B is a side elevational view of a head handler, which may be used in conjunction with Applicant's head puller assembly.

Rotatable neck 16 is seen to have at a removed end thereof gearbox 24 attached thereto as by, for example, welded areas 42. Gearbox 24 includes a housing 30, typically rectangular and made of ⅛ inch steel (or other suitable material) welded up around a first or drive gear 26 and a second or driven gear 28, which are typically both spur gears designed to meshingly engage one another, such that rotation of the typically smaller drive gear 26 causes the typically larger driven gear 28 to rotate. The diameter of the drive gear is typically smaller and thus the rotation of the drive gear acts as a torque multiplier. Second gear 28 has a hub 28*a* whose inner surface is threaded to match the threads of lifting shaft 44, as seen in FIG. 4B. Moreover, both gears are seen to have a thickness, as seen in FIG. 4B, such that they are snug against, or only have a slight gap, between the gears and top wall 32 and bottom wall 34. Housing 30 also includes four side walls 36 and is generally rectangular. Up and down movement of the gears 26/28 as seen in FIG. 4B is substantially prevented by dimensioning the distance between top wall 32 and bottom wall 34 to be only slightly larger than the thickness of the gears.

Sliding of the gears around inside the space of the housing 30 s prevented since first gear 26 is engaged to a drive shaft 38. Drive shaft 38 articulates in a pair of drive shaft holes 32*a* (in top wall) and 34*a* (in bottom wall) to positionally maintain drive shaft 38, which is splined, keyed or otherwise engaged to drive gear 26. Moreover, a removed end of drive gear 38 may include a ratchet coupling or drive tool receiving member 38*a* as seen in FIG. 4B, for coupling to a motorized or hand driven ratchet, which will in turn rotate the drive gear 26 and the driven gear 28.

Driven gear 28 at the threaded internal hub 28*a* engages the threads of lifting shaft 44. Lifting shaft 44 is designed to thread through the housing 30. That is to say, housing 30 has top wall hole 32*b* and bottom wall hole 34*b* that are cut in a diameter about equal to the non-threaded portion of the threaded lifting shaft 44, so that threaded shaft 44 moves vertically through the housing and the driven gear to extend up therethrough as best seen in FIG. 4B. Thus, lifting shaft 44 actually assists in locating driven gear 28 with respect to the box and also is driven by it, since driven gear couples at its internal hub 28A with the threads of lifting shaft 44.

Turning now to FIGS. 2A and 2B, it is seen that lifting shaft 44 may have a hook 46 mounted at a removed end thereof, for example, through the use of a pin 48. It can be seen then that, if the hook is mounted to something heavy, such as a head H2, that a ratchet or other drive tool (not shown) applied to drive shaft 38 will cause the lifting shaft to move vertically upward.

Engagement of hook 46 to head H2 may be assisted through the use of a head anchor assembly 50. Head anchor assembly 50 may include a hook engaging member 52, which is typically shaped like an inverted "U" and has at the removed outer ends thereof, vertically trending channel members 54/56. Centering the hook engaging member 52 on hook 46 as seen in FIG. 1, with fasteners F1 and F2 engaging channel members 54/56 and at least partially threaded into the head, secure engagement of head H2 to head puller assembly 10 is achieved with rotation of drive shaft 38, such as by a ratchet wrench or other drive tool (not shown) causing the lifting of the head anchor assembly 50 along with the head engaged therewith from the block portion adjacent to head H1.

Welded areas 42 illustrate the manner in which gearbox 24 may be engaged to the removed end of the horizontal portion of rotatable neck 16, such that the gearbox is in a horizontal plane. The gearbox housing may also have a grease fitting 29 engaged therewith and it may be packed with a heavy grade grease to help ensure ease of movement and meshing of the gears.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A head removing device for removing a head from an engine having multiple heads, the head removing device comprising:

a crane assembly, the crane assembly including a fixed length, non-extendable support member having a first end and a second end, the crane assembly including mounting means near the first end of the support member, the mounting means adapted to engage a first head of the engine, at least a portion of the support member adapted to rotate about a vertical axis such that the second end of the support member is positionable over a second head of the engine;

a gear box located near the second end of the support member, the gearbox including a drive gear and a driven gear directly meshingly engaged with one another with the drive gear having a drive mechanism which has a tool engaging portion thereon, the driven gear having a threaded inner perimeter, the gearbox including a gearbox housing for substantially enclosing the at least two gears;

a rigid threaded lifting shaft having a longitudinal axis, the lifting shaft having a removed end, the lifting shaft for engaging the threaded inner perimeter of the driven gear, such that when such gear is rotated, the lifting shaft moves; wherein the lifting shaft passes through the gearbox housing;

wherein the drive and driven gears lay in a first plane and the rigid, threaded lifting shaft moves in a plane perpendicular to the first plane; and a head anchor assembly including at least a pair of anchor head engaging bolts for attaching to the removed end of the lifting shaft, the head anchor assembly including at least a pair of spaced apart members adapted to receive at least a pair of anchor head engaging bolts, a pair of spaced apart members dimensioned to engage a head separate from the head of the crane assembly mounting means.

2. The head removing device of claim 1, wherein the gearbox housing includes walls, including a top wall and a bottom wall, and wherein the first gear is engaged with the top and bottom wall, and rotatably articulates with respect to the top and bottom walls.

3. The head removing device of claim 1, wherein the at least two gears include toothed outer perimeters for meshing engagement and wherein the second of the at least two gears includes means to engage the lifting shaft such that rotation of the second gear imparts linear motion to the lifting shaft, along its longitudinal axis.

4. The head removing device of claim 3, wherein the lifting shaft is threaded and wherein means to engage the lifting shaft includes a threaded inner perimeter of the second gear.

5. The head removing device of claim 1, wherein the removed end of the lifting shaft includes a hook, the hook adapted to engage the head anchor assembly.

6. The head removing device of claim 1, wherein the head anchor assembly includes a horizontal cross-member, and wherein the members of the head anchor assembly that are adapted to engage the anchor head engaging bolts are engaged with and separated by the horizontal cross-member.

7. The head removing device of claim 1, wherein the removed end of the lifting shaft includes a hook, the hook adapted to engage the head anchor assembly; and wherein the pair of members of the head anchor assembly are adapted to engage the anchor head engaging bolts engaged with and separated by a horizontal cross-member.

8. The head removing device of claim 1, wherein the gearbox housing includes walls, including a top wall and a bottom wall, and wherein the first gear is engaged with the top and bottom wall, and rotatably articulates with respect to the top and bottom walls; and wherein the lifting shaft passes through the top wall and the bottom wall.

9. The head removing device of claim 1, wherein the gearbox housing includes walls, including a top wall and a bottom wall, and wherein the first gear is engaged with the top and bottom wall, and rotatably articulates with respect to the top and bottom walls; wherein the lifting shaft passes through the top wall and the bottom wall; wherein the at least two gears include toothed outer perimeters for meshing engagement and wherein the second of the at least two gears includes means to engage the lifting shaft such that rotation of the second gear imparts linear motion to the lifting shaft, along its longitudinal axis; wherein the lifting shaft is threaded and wherein means to engage the lifting shaft includes a threaded inner perimeter of the second gear; wherein the removed end of the lifting shaft includes a hook, the hook adapted to engage the head anchor assembly; and wherein the members of the head anchor assembly are engaged with and separated by a horizontal cross-member; and wherein the hook of the lifting shaft is adapted to engage the horizontal cross-member.

* * * * *